US005493831A

United States Patent [19]

Jansson

[11] Patent Number: 5,493,831

[45] Date of Patent: Feb. 27, 1996

[54] METHOD AND ARRANGEMENT FOR SECURING GLASS FACADE ELEMENTS

[76] Inventor: Nils-Gunnar Jansson, Grev Magnigatan 10, S-114 55 Stockholm, Sweden

[21] Appl. No.: 211,183

[22] Filed: Mar. 23, 1994

[30] Foreign Application Priority Data

Sep. 24, 1991 [SE] Sweden ..... 9102766

[51] Int. Cl.[6] ..... E06B 3/54

[52] U.S. Cl. ..... 52/235; 52/204.593; 52/489.1; 52/786.13

[58] Field of Search ..... 52/235, 204.1, 52/208, 204.5, 204.57, 204.67, 396.07, 506.08, 506.06, 489.1, 788, 789, 172, 204.591, 204.593, 204.598

[56] References Cited

U.S. PATENT DOCUMENTS

| | | | |
|---|---|---|---|
| 3,714,747 | 2/1973 | Curran | 52/489.1 |
| 3,871,150 | 3/1975 | Murray et al. | 52/506.08 |
| 4,110,948 | 9/1978 | Maier, Jr. | 52/489.1 |
| 4,475,325 | 10/1984 | Veldhoen | 52/235 |
| 4,552,790 | 11/1985 | Francis | 52/235 |
| 4,691,489 | 9/1987 | Shea, Jr. | 52/208 |
| 4,756,131 | 7/1988 | Stoakes | 52/235 |
| 4,961,975 | 10/1990 | Bejnar | 52/788 |
| 5,048,249 | 9/1991 | Shreiner et al. | 52/396.07 |
| 5,199,236 | 4/1993 | Allen | 52/235 |

FOREIGN PATENT DOCUMENTS

| | | |
|---|---|---|
| 0250989 | 1/1988 | European Pat. Off. . |
| 3439436 | 4/1986 | Germany . |
| 3801826 | 8/1989 | Germany . |
| 9105924 | 5/1991 | WIPO . |

*Primary Examiner*—Carl D. Friedman
*Assistant Examiner*—Winnie S. Yip
*Attorney, Agent, or Firm*—Nies, Kurz, Bergert & Tamburro

[57] ABSTRACT

A method and an arrangement for securing glass facade elements comprised of sealed glazing units which include at least two parallel glass sheets separated by a spacer which extends between the glass sheets and terminates short of the outer edges of the sheets, wherein a glue layer is applied between the glass sheets but outwardly of the spacer, and wherein facade elements are secured to a frame structure and preferably a frame structure comprised of aluminum profiled sections and having a clip placed and penetrating the glue layer between the glass sheets of two neighboring facade elements.

10 Claims, 2 Drawing Sheets

METHOD AND ARRANGEMENT FOR SECURING GLASS FACADE ELEMENTS

BACKGROUND OF THE INVENTION

1. Field of the Invention

The present invention relates to a method and to an arrangement for securing glass facade elements. The invention is concerned primarily with facade elements in the form of glass sheets or panes which are glued to a frame structure. Such frame structures may be constructed from aluminium profiled sections.

2. Description of the Related Art

In recent times, it has become more and more usual to provide building structures, such as office buildings, with a full-covering glass facade. The glass sheets are herewith glued to a rearwardly-lying frame construction and the glue, or adhesive, used is load-carrying both with respect to positive and negative wind loads. Constructions are found in which the glass sheets are supported solely by the adhesive, although there are also found constructions in which, for instance, the bottom edges of the glass sheets rest on a frame part, so that the static load will be taken-up mechanically by the frame structure.

Glass facades of this kind are normally constructed with the aid of sealed double-glazing units. Sealed double-glazing insulating units are constructed with a spacer between the glass sheets, so as to hold the sheets at a given distance apart. An adhesive, or glue, is applied outside the spacer, but between the sheets. The purpose of the adhesive is to hold the glass sheets glued together, and also to form a seal between the surroundings and the space between the sheets. The adhesive used is normally a silicone glue. The glue is applied in the factory, under precise conditions, and consequently the glue joint will not loosen on the insulation unit fitted to the facades.

In the case of known facades of this kind, the known technique used involves gluing the glass sheets of the glazing units that lies closest to the frame structure directly onto said frame structure. This is carried out on the building site, and consequently the glue joints obtained are liable to vary in quality, among other things due to the weather conditions that prevail at that particular time.

It is obvious that a sealed glazing unit thus secured is liable to loosen and fall onto the ground below. It is also obvious that a falling sheet of glass can cause serious injury to people in the vicinity of the glass and also serious damage to property. However, with regard to the aesthetic appearance of the facade, it is important that no fastener devices are visible to the viewer, for instance extending in the joints between two adjacent glazing units and on the outside of said units. There is no doubt that a mechanical fastener arrangement would eliminate the risk of the unintentional release of a glazing unit, even if its glue bond with the frame structure should fail.

The problem solved by means of the present invention is thus that of securing glazing units with the aid of mechanical means without the use of surface-mounted fastener devices.

SUMMARY OF THE INVENTION

Accordingly, the present invention relates to a method for securing glass facade elements which are comprised of sealed glazing units which include at least two parallel glass sheets which are separated mutually by a spacer that extends between the glass sheets slightly and terminates short of the outer edges thereof, where glue is applied between the glass sheets but outwardly of the spacer, said facade elements being fastened to a frame structure, preferably a frame structure comprises of aluminium profiled sections, and is characterized in that when assembling the facade elements a clip is fitted between two mutually adjacent elements and secured mechanically to the frame structure, said clip having two tongues which extend obliquely in mutually opposite directions towards the frame structure; in that when no load acts on the clip the distance between the free extremities of the tongues exceeds the distance between two mutually adjacent facade elements; and in that when fitting the clip, said clip is deformed elastically so as to bring the tongues closer together, whereafter the clip is placed between two mutually adjacent facade elements, whereafter the clip is subjected to load and secured in the frame structure as the tongues penetrate the glue layer applied between the glass sheets but outwardly of the spacer.

The invention also relates to a structural arrangement for securing a plurality of glass facade elements to a frame structure.

BRIEF DESCRIPTION OF THE DRAWINGS

The invention will now be described in more detail, partly with reference to exemplifying embodiments of the invention illustrated in the accompanying drawings, in which.

DESCRIPTION OF THE PREFERRED EMBODIMENTS

Figure 1:
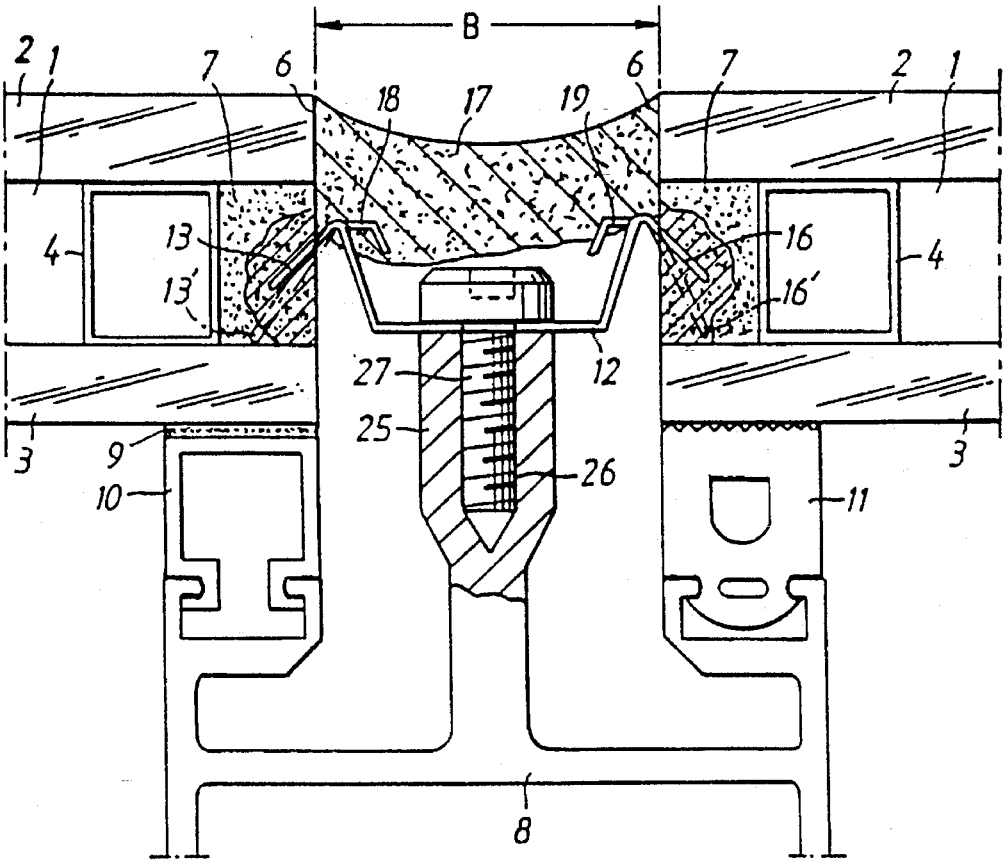
FIG. 1 is a section view of an inventive arrangement mounted between two mutually adjacent glass facade elements.

FIG. 1 illustrates an arrangement for securing glass facade elements comprised of sealed glazing units that include at least two parallel glass sheets 2, 3. The glass sheets are held separated by a spacer 4 which extends between the glass sheets 2, 3 and terminates short of the outer edges 6 of the glass sheets. Glue 7 is applied between the glass sheets 2, 3 but outwardly of the spacer 4. Such sealed glazing units have long been known. The glue 7 is applied in the factory.

With regard to building constructions that have glass facades, the facade elements 1 are secured to a frame structure 8, preferably a frame structure comprised of aluminum profiled sections, this frame structure in turn being secured to the building. Only a part of one such frame structure is illustrated in FIG. 1.

Hitherto, glass facade elements 1 have been glued to the frame structure 8. This is illustrated in the left-hand part of FIG. 1, which shows the glass panes or sheets glued at 9 to a part 10 of the frame structure 8. These glue joints are effected on the building site and, as previously mentioned, the quality of the glue joints may vary from one joint to the other and therewith, in some instances, result in the facade element 1 falling from the building.

A so-called weather seal 17, i.e. a sealing compound, such as silicone, is provided between two neighbouring facade elements.

Shown in the right-hand part of FIG. 1 is another embodiment which is made possible by means of the present invention, namely an embodiment in which the facade element is not glued to the frame structure 8 at all, but simply rests on, e.g., a rubber strip 11 secured in said structure. Naturally, only one of the two embodiments illustrated in FIG. 1 are used in one and the same building.

Figure 2:
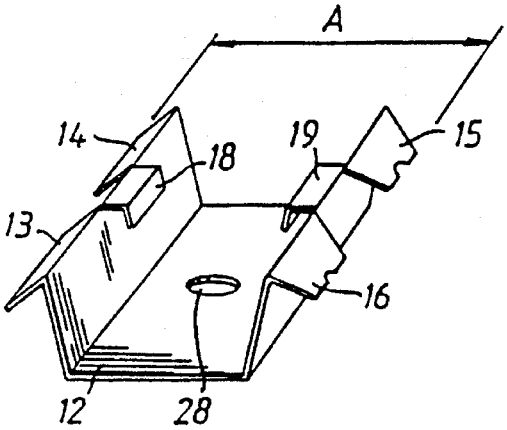
FIG. 2 illustrates a clip used in accordance with the invention.
Figure 3A:
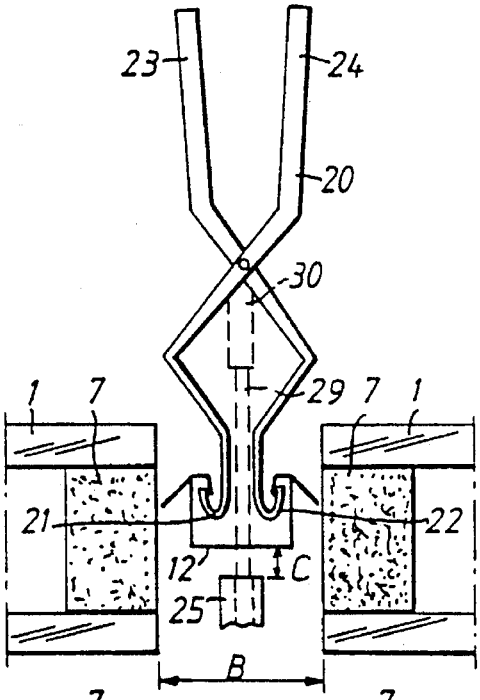
FIGS. 3*a*–3*c* illustrate fitting of the inventive arrangement.
Figure 3B:
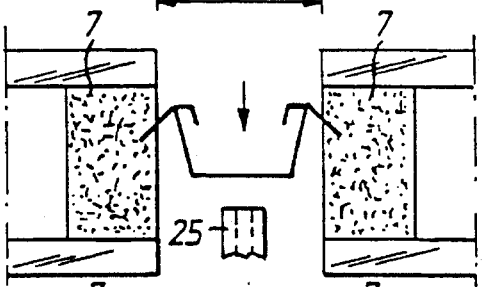
Figure 3C:
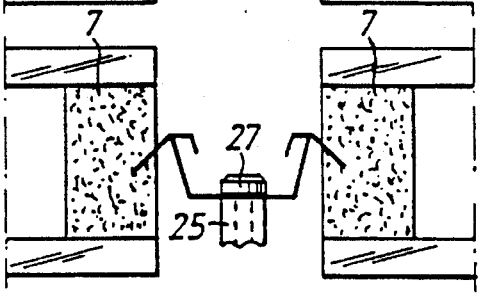

The inventive arrangement includes a clip 12 which is intended to be fitted between two neighbouring facade elements 1, said clip 12 being intended to be secured mechanically in the frame structure. FIG. 2 illustrates one embodiment of the clip. The clip 12 has two tongues which extend obliquely outwards in two mutually opposite directions. The clip shown in FIG. 2 has four such tongues 13, 14; 15, 16. When no load acts on the clip the distance A between the outer extremities of the tongues 13, 16; 14, 15 exceeds the distance B between two neighbouring facade elements 1. The clip 12 is elastically deformable, so that the tongues can be brought closer together and thereby enable the clip 12 to be placed between two neighbouring facade elements 1, as illustrated in FIG. 3a. When the clip is subjected to load, the tongues 13–16 are able to penetrate the glue 7 between the glass panes or sheets 1, 2, see FIG. 3*b* and 3*c*.

According to one preferred embodiment, the clip 12 has a generally U-shape with the tongues 13–16 extending from the upper parts of the U and obliquely outwards and downwards, as illustrated in FIG. 2. It will be understood, however, that the clip may be given a different configuration without changing its function.

According to one preferred embodiment, the clip is also provided with two further tongues 18, 19, which extend obliquely downwards and inwards from the upper parts of the U-form. When fitting the clip in position, these tongues 18, 19 are intended to coact with a tool 20 such as to squeeze the clip together and therewith shorten the distance between the first mentioned tongues 13–16, as before mentioned, and therewith enable the clip to be inserted between two neighbouring facade elements 1.

The tool 20 is illustrated in FIG. 3 and comprises a pair of tongs having two rearwardly curved front parts 21, 22 on respective legs, these rearwardly curved, or bent, parts being intended for insertion behind the further tongues 18, 19. The clip is squeezed together, so that it can be inserted between two neighbouring facade elements, by moving the handles 23, 24 of the tongues towards one another.

According to one preferred embodiment, the clip 12 is made from stainless spring-steel sheet. A suitable sheet: thickness is 0.5 millimeter, for instance.

Figure 4:
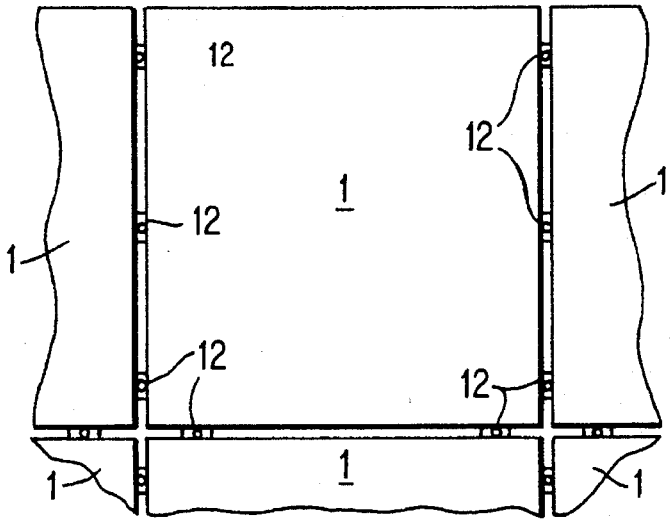
FIG. 4 is a fragmentary elevational view showing a plurality of adjacent facade elements connected together.

One or more clips are fastened on each side of a facade element. Preferably, a number of clips are fastened along each side. FIG. 4 shows several adjacent facade elements 1 that are each interconnected by a plurality of clips 12.

When fitting the facade elements 1 in position, a clip 12 is placed between two neighbouring facade elements 1 and fastened mechanically in the frame structure 8. When fitting the clip 12, the clip is deformed elastically with the aid of the tool 20, so that the tongues 13–16 will approach one another, whereafter the clip is placed in position between two neighbouring facade elements 1. The clip 12 is then released and secured in the frame structure as the tongues penetrate the glue layer 7 between the glass sheets 1, 2, but outwardly of the spacer.

When fitting the clip 12, the clip is placed initially a short distance from the frame structure 8, so that the clip 12 will be located at a distance C from an outwardly-projecting part 25 of the frame structure 8, see FIG. 3*a*. The outwardly-projecting part 25 has an axially-extending screw channel 26 in which a screw 27 is intended to be tightened. The screw 27 is intended to extend through a hole 28 in the clip. When the clip is positioned in the aforesaid manner and the load acting thereon is relieved, the first mentioned tongues 13–16 will lie against the glue layer 7, see FIG. 3*b*. The clip is then screwed firmly to the frame structure 8 and is therewith displaced into abutment with the frame structure while the tongues spring outwards and penetrate the glue layer, see FIG. 3*c* and FIG. 1.

Tongues 13, 16 which have penetrated the glue layer 7 are shown in full lines in FIG. 1, these tongues not being in abutment with a glass sheet or pane 3. This embodiment of the tongues 13–16 is fully satisfactory when the facade elements are glued directly against the frame structure 8 by means of a glue joint 9, as illustrated in the left-hand part of FIG. 1. However, when the facade elements are not glued directly to the frame structure, but instead merely lie against a rubber strip 11, the inventive arrangement can be used as the sole means of securing the facade elements to the frame structure. This is illustrated in FIG. 1 with the aid of the tongues 13', 16' shown in broken lines. In this embodiment, the tongues have a length such that when the clip is tightened by means of the screw 27, the tongues 13', 16' will lie in abutment with the glass sheets 3.

In order to facilitate positioning of the clip at the aforesaid distance C from the outwardly-projecting part: 25, the tool 20 may be provided with a rod 29, shown in broken lines in FIG. 3*a*, which extends through the hole 28 provided in the clip and projects from beneath the clip through a distance corresponding to the aforesaid distance C. The tool is therewith lowered until the forward end of the red 29 comes into contact with the outwardly-projecting part 25, whereafter load is relieved from the clip by means of the tool and the tool withdrawn. According to one embodiment, the red 29 may be screwed into a sleeve 30 so as to enable the extent to which the rod 29 projects from the tool to be adjusted in accordance with the position of the outwardly-projecting part 25 in relation to the facade elements.

It will be evident that the present invention solves the problem mentioned in the introduction, in a simple and effective manner.

Although the invention has been described with reference to various embodiments thereof, it will be obvious to those skilled in this art that the construction of the arrangement can be varied without changing its function.

The present invention is therefore not restricted to the afore-described and illustrated embodiments thereof, since modifications can be made within the scope of the following claims.

I claim:

1. A method for securing glass facade elements which are comprised of sealed glazing units which include at least two parallel glass sheets (2, 3) separated by a spacer (4) which extends between the glass sheets and terminates short of the outer edges of said sheets, wherein a glue layer (7) is applied between the glass sheets but outwardly of the spacer, and wherein facade elements are secured to a frame structure (8), preferably a frame structure comprised of aluminium profiled sections, characterized in that when fitting the facade element (1) a clip (12) is inserted between two adjacent neighbouring facade elements, said clip (12) being secured mechanically in the frame structure (8) and having two tongues (13, 16; 14, 15) which project outwardly and obliquely in opposite directions on each opposite side of said clip towards the frame structure; in that when no load acts on the clip, the distance (A) between the free extremities of the tongues exceeds the distance (B) between two adjacent neighbouring facade elements (1); and in that when fitting the clip (12) in position, said clip being loaded, the tongues (13, 16; 14, 15) are deformed elastically and caused to approach one another, whereafter the clip is placed between two adjacent neighbouring facade elements and the load on the clip is removed, therewith securing the clip in the frame structure (8) with the tongues (13–16) penetrating said glue layer (7) between the glass sheets, but outwardly of the spacer (4).

2. A method according to claim 1, including providing a generally U-shape to the clip and extending said tongues, from the upper parts of the U-shape of the clip, obliquely outwards and downwards away from the center portion of the clip.

3. A method according to claim 2, characterized in that the clip (12) is provided with two further tongues (18, 19) which extend obliquely downwards and inwards from the upper parts of the U-shape and which, when fitting the clip, are caused to coact with a tool for squeezing the clip (12) together so that said distance (A) between the first mentioned tongues is decreased and therewith enable the clip to be inserted between two neighbouring adjacent facade elements, as before mentioned.

4. A method according to claim 1, characterized in that when fitting the clip (12), the clip is placed initially at a distance (C) from the frame structure (8), such that the first mentioned tongues (13–16) will lie against the glue layer (7); and in that the clip is then screwed in the frame structure, said clip being displaced into abutment with the frame structure and the tongues (13–16) being caused to penetrate the glue layer (7).

5. A method according to claim 1, characterized in that one or more clips (12) are fastened at each side of a facade element (1).

6. An arrangement for securing glass facade elements comprised of two separated sealed glazing units which each of said units includes at least two parallel glass sheets (2, 3) separated by a spacer (4) which extends between the glass sheets and terminates short of the outer edges of said sheets, wherein a glue layer (7) is provided between the glass sheets and outwardly of the spacer, and wherein facade elements (1) are fastened to a frame structure (8), preferably a frame structure comprised of aluminium profiled sections, characterized: in that the arrangement includes an elastically deformable clip (12) which is intended to be fitted between two adjacent neighbouring facade elements (1) and fastened mechanically to the frame structure; in that the clip has a center portion with a U-shaped cross-section having two sides, each side having two tongues (13, 16; 14, 15) which project outwardly from the said center portion in opposite directions and obliquely in towards the frame structure (8); in that, when the clip is not deformed by loading forces, a distance (A) between the free outer extremities of the tongues (13, 16; 14, 15) exceeds a distance (B) between two neighbouring adjacent facade elements (1); and in that the clip (12) is elastically deformable, under loading when fitted between two adjacent facade elements, so that the tongues are able to approach one another and therewith enable the clip to be inserted between two neighbouring adjacent facade elements and so that, when the loading acting on the clip (12) is relieved, the clip (12) will spring-back essentially to its unloaded condition so that the tongues (13–16) are able to penetrate the glue layer (7) between the glass sheets, and outwardly of the spacer (4).

7. An arrangement according to claim 6, wherein the tongues (13–16), extend outward from the sides of the clip and obliquely in a direction toward the center portion of the clip.

8. An arrangement according to claim 7, characterized in that the clip (12) is provided with two further tongues (18, 19) which extend obliquely downwards and inwards from the upper parts of the U-shape, said further tongues (18, 19), when fitting the clip, being intended to coact with a tool which functions to squeeze the clip (12) together so that, as before mentioned, the distance (A) between the first mentioned tongues is decreased and therewith enables the clip to be inserted between two neighbouring adjacent facade elements.

9. An arrangement according to claim 6, characterized in that one or more clips (12) are fitted on adjacent sides of adjacent elements.

10. An arrangement according to claim 6, characterized in that the clip (12) is made of stainless spring steel.

* * * * *

UNITED STATES PATENT AND TRADEMARK OFFICE

CERTIFICATE OF CORRECTION

PATENT NO. : 5,493,831

DATED : February 27, 1996

INVENTOR(S) : NILS-GUNNAR JANSSON

It is certified that error appears in the above-indentified patent and that said Letters Patent is hereby corrected as shown below:

On the Title page, correct item [22] to read:

[22] PCT filed: September 24, 1992

On the COVER PAGE, add the following item:

[63] Filed as PCT/SE92/00663 on March 23, 1994.

Signed and Sealed this

Eleventh Day of June, 1996

*Attest:*

Bruce Lehman

BRUCE LEHMAN

*Attesting Officer*

*Commissioner of Patents and Trademarks*